US009964379B2

(12) United States Patent
Farren

(10) Patent No.: US 9,964,379 B2
(45) Date of Patent: May 8, 2018

(54) ARCHERY BOW BRAKE

(71) Applicant: Jon P. Farren, Boise, ID (US)

(72) Inventor: Jon P. Farren, Boise, ID (US)

( * ) Notice: Subject to any disclaimer, the term of this patent is extended or adjusted under 35 U.S.C. 154(b) by 0 days. days.

(21) Appl. No.: 15/346,130

(22) Filed: Nov. 8, 2016

(65) Prior Publication Data

US 2017/0131057 A1 May 11, 2017

Related U.S. Application Data

(63) Continuation-in-part of application No. 14/937,555, filed on Nov. 10, 2015, now Pat. No. 9,518,798.

(51) Int. Cl.
*F41B 5/10* (2006.01)
*F41B 5/14* (2006.01)

(52) U.S. Cl.
CPC ..... *F41B 5/1469* (2013.01); *F41B 5/10* (2013.01); *F41B 5/105* (2013.01)

(58) Field of Classification Search
CPC ..... F41B 5/10; F41B 5/123; F41B 5/14
See application file for complete search history.

(56) References Cited

U.S. PATENT DOCUMENTS

| | | | |
|---|---|---|---|
| 4,294,221 | A | 10/1981 | Bryant |
| 4,471,747 | A | 9/1984 | Nishioka |
| 4,886,039 | A | 12/1989 | Wagner |
| 5,000,154 | A | 3/1991 | Slayton |
| 5,002,035 | A | 3/1991 | Brooks |
| 5,092,309 | A | 3/1992 | Beaton |
| 5,146,908 | A | 9/1992 | Larson |
| 5,465,705 | A | 11/1995 | Baeseman |
| 5,967,131 | A | 10/1999 | Hervig |
| 6,032,660 | A | 3/2000 | Hervig |

*Primary Examiner* — John Ricci
(74) *Attorney, Agent, or Firm* — Hawley Troxell Ennis & Hawley LLP; Philip McKay

(57) ABSTRACT

What is disclosed is a braking mechanism for holding a bow string at full draw or any partial draw position along the length of a draw stroke, to enable an archery bow user to maintain a full or partial draw for longer durations of time while exerting less strength or energy than without engaging the braking mechanism.

15 Claims, 8 Drawing Sheets

ARCHERY BOW BRAKE

CROSS REFERENCE TO RELATED APPLICATIONS

This application is a continuation-in-part patent application that claims the benefit of and priority to, under 35 U.S.C. § 120, U.S. patent application Ser. No. 14/937,555 filed on Nov. 10, 2015, entitled "ARCHERY BOW BRAKE," which is hereby incorporated by reference in its entirety.

BACKGROUND

Compound archery bows are very popular for hunting and target shooting. These bows use a bowstring stretched between one or more pulleys and/or cams. There are a variety of orientations of bowstrings, cams/pulleys, and (on some bows) cables, of which one or more types of bows is discussed herein as an example.

Maintaining a drawn bow string can tire an archer quickly, and a tired archer is less likely to be able to continue to effectively hold a drawn bowstring and/or is less likely to be able to continue to shoot a bow effectively. For example, if an archer is hunting and hears game approaching, the archer may want to or need to hold a bowstring in the drawn position for several minutes, before the hunted game enters a distance at which the archer can effectively place an arrow into the vital organs of the game. For some archers the draw weight of a bow string is only 15-20 pounds, but for more advanced archers, a draw weight of a bowstring may be set to as high as 60 to 80 pounds. A higher draw weight corresponds with a bow's ability to shoot an arrow farther, with less drop, and with more speed. However, some archers sacrifice higher draw weights (and the corresponding benefits) in place of draw weights that the archers can hold for longer periods of time, even though the archers are fully capable of drawing higher draw weights.

SUMMARY

Embodiments of the present disclosure include various techniques and configurations for an archery bow brake that enables an archery bow user (e.g., an archer) to maintain a full or partial draw of a bow string with reduced effort. A draw weight is an amount of force (usually measured in pounds) that needs to be exerted to draw a bow string from a resting position to a full or partially drawn position. A holding force is different than a draw weight, and the holding force refers to an amount of force that needs to be applied to the bow string to maintain the bow string at a particular position (e.g., full or partial draw). The archery bow brake, when engaged or actuated, reduces the holding force to near zero pounds for a user (as measured by the user's drawing arm), according to one embodiment. In other words, when operated/actuated, the archery bow brake allows a user to merely apply enough holding force to keep slack out of the bow string. The archery bow brake includes several different configurations, according to various embodiments.

Modern compound archery bows have numerous configurations of strings, cables, wheels, and cams. The herein disclosed embodiments of an archery bow brake holds the draw position of the bow at any position in the draw cycle by preventing vertical travel (e.g., linear motion from limb to limb) of one or more strings and/or cables, according to one embodiment. Holding the draw position of the bow by preventing vertical travel (or linear motion) of one or more strings and/or cables prevents the cam or cams from rotating back to the (non-drawn) resting position and prevents the limbs (e.g., an upper limb and a lower limb) from returning to the (non-drawn) resting position, in order to maintain all (or substantially all) of the energy the archer has transferred to the compound archery bow during the draw cycle.

In one embodiment, the archery bow brake includes a brake lever, a brake actuator, and a caliper that applies friction to at least two sides of a bow string, in order to reduce the effort of the archery bow user in maintaining a compound archery bow in a fully or partially drawn position.

In one embodiment, the archery bow brake includes a brake lever, a brake actuator, and a bow string displacer. The bow string displacer (in response to actuation of the brake lever) moves a bow string (e.g., a control cable or a bus cable of a compound archery bow) into a notch of a cable rod, according to one embodiment. After the bow string is moved or displaced into the notch, the notch in the cable rod retains a ferrule (or other accessory) that is affixed to one or more of the bow strings, to maintain the position of the bow string in a fully or partially drawn position.

The bow string displacer can be implemented using one or more of a variety of techniques. In one embodiment, the bow string displacer includes a paddle or flexible lever that displaces the bow string into the notch, in response to actuation of the brake lever. In one embodiment, the bow string displacer includes a hook that displaces the bow string into the notch, in response to actuation of the brake lever. In one embodiment, the bow string displacer includes a notch that is displaced from the cable rod to one or more of the bow strings, in response to actuation of the brake lever, in order to retain a position of the one or more bow strings (e.g., by retaining a ferrule, a loop on the bow string, a knot in the bow string, etc.).

These and other embodiments are disclosed in more detail below.

Figure 1:
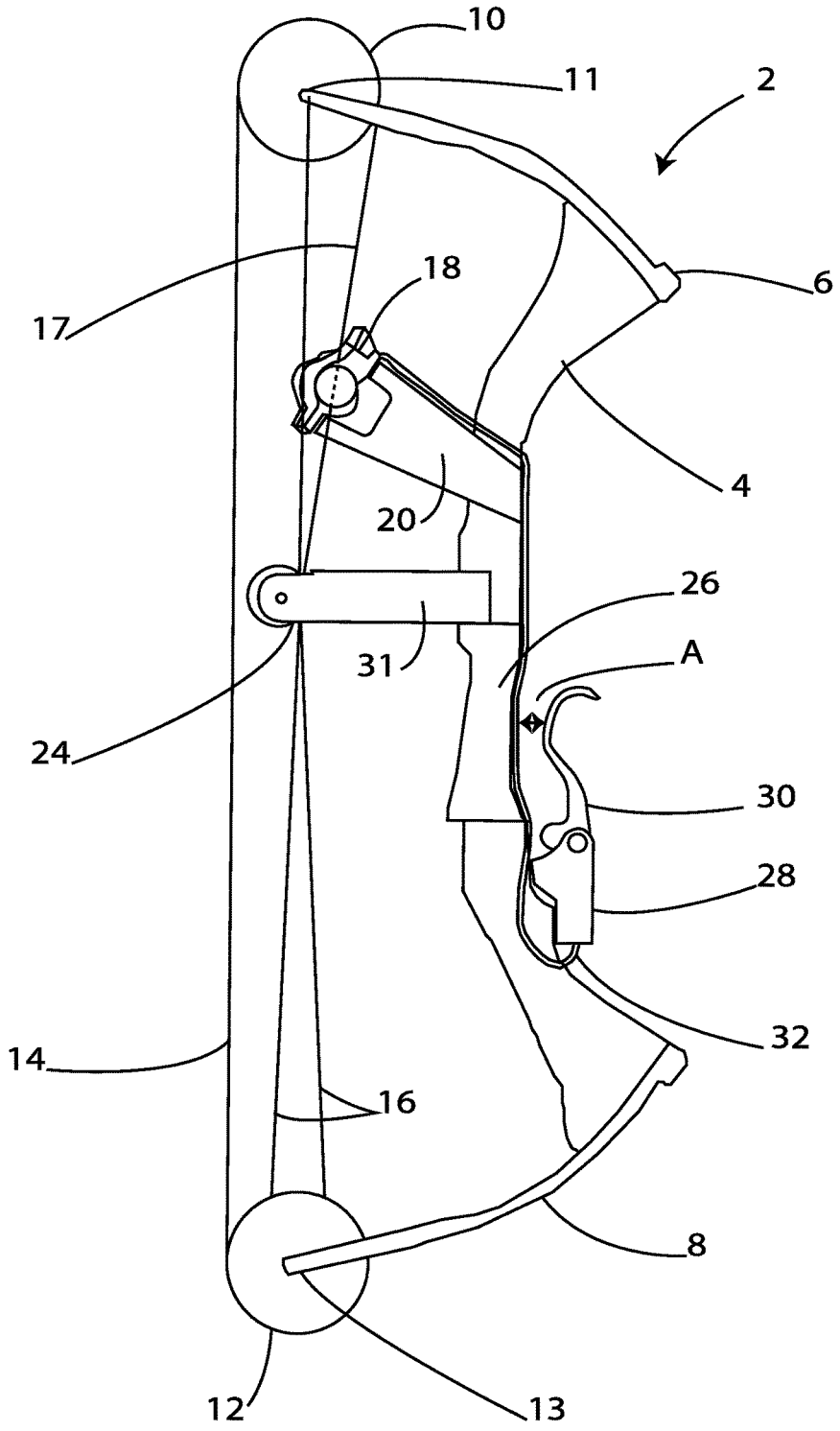
FIG. 1 is a perspective view of a compound archery bow including an embodiment of an archery bow brake, according to one embodiment.

Common reference numerals are used throughout the FIGs. and the detailed description to indicate like elements. One skilled in the art will readily recognize that the above FIGs. are examples and that other architectures, modes of operation, orders of operation, and elements/functions can be provided and implemented without departing from the characteristics and features of the invention, as set forth in the claims.

DETAILED DESCRIPTION

Embodiments will now be discussed with reference to the accompanying figures, which depict one or more exemplary embodiments. Embodiments may be implemented in many different forms and should not be construed as limited to the embodiments set forth herein, shown in the figures, or described below. Rather, these exemplary embodiments are provided to allow a complete disclosure that conveys the principles of the invention, as set forth in the claims, to those of skill in the art.

FIG. 1 illustrates a compound archery bow 2 having an archery bow brake that facilitates maintaining an archery bow at full or partial draw by an archery bow user, according to one embodiment. Embodiments of the archery bow brake include components that assist archery bow users in maintaining a full or partial draw for longer durations of time without exerting the strength or endurance that is typically exerted in holding the bowstring of the compound archery bow 2 at full or partial draw. Embodiments of the archery bow brake can offer several advantages to the archery bow user. For example, with a reduction or removal of the exertion of maintaining full or partial draw of the compound archery bow 2, an archery bow user may be able to more accurately fire an arrow after maintaining the draw on the bow because the user's arms and/or back muscles may be less exhausted/tired than when the user is forced to exert energy/effort to maintain the draw. When hunting and waiting for game to approach, the ability to wait for the game to approach at full or partial draw may significantly reduce the likelihood of an archery bow user being detected by game due to the user's motion of drawing the bow. Furthermore, follow-up shots may also be easier for an archery bow user who has used the disclosed archery bow break to maintain a draw, instead of exerting the user's own strength. As another example, windy conditions can cause an archery bow user to need to maintain a draw on a bow while the archery bow user attempts to acquire target.

The compound archery bow 2 has bow riser 4 between an upper limb 6 and a lower limb 8, according to one embodiment. At the distal ends 11, 13 of the upper limb 6 and lower limb 8 are cams 10, 12 in a dual cam bow or a cam 12 and an idler pulley 10 in a single cam bow, according to one embodiment.

A bow string 14 stretches between the cams or pulleys, according to one embodiment. String or cables 16 also stretch between the cams or pulleys, according to one embodiment. The string or cables 16, along with the bow string 14 are collectively referred to as a bow string, according to one embodiment. Accordingly, because the disclosed archery bow brake applies one or more braking techniques to one or more of the bow string 14 and the string or cables 16, the disclosed archery bow brake generically applies a brake to the "bow string", according to one embodiment. One of the strings or cables 16 is a bus cable and one of the strings or cables 16 is a control cable, according to one embodiment. The bus cable attaches between the upper limb 6 and the cam 12, according to one embodiment. The control cable attaches to the compound archery bow 2 from the lower limb 8, around the cam or idler pulley 10 and around the cam 12, according to one embodiment. In the depicted embodiment, the string or cables 16 are retained together at cable retainer 24, which is attached to a cable guard 31, according to one embodiment. The cable retainer 24 is a cable slide, according to one embodiment. The cable retainer 24 includes a pulley, according to one embodiment.

The braking device of the present invention includes caliper 18 located on one of the two cables 17, according to one embodiment. In other words, the caliper 18 is positioned proximate to one of the two cables 17 to apply friction to one or more of the two cables 17, according to one embodiment. The two cables 17 are the same as the string or cables 16, which have extended through the cable retainer 24, according to one embodiment. One of the two cables 17 runs between one or more brake pads of the caliper 18, according to one embodiment. The caliper 18 is attached to a brake actuating device 28 by cable 32. Cable 32 can be hydraulic, mechanical or electrically connected between the caliper 18 and the brake actuating device 28, according to one embodiment. The brake actuating device 28 and the caliper 18 (e.g., the brake device) can employ an electromagnetic connection or communication channel to wirelessly actuate the caliper 18 from the brake actuating device 28, according to one embodiment. In the depicted embodiment, the brake is actuated by (or in response to) depression of brake lever 30, which is located proximate to the grip 26 (or handle) of the bow to actuate the caliper 18, according to one embodiment. The brake actuating device is a mechanical, hydraulic, or electrical brake actuator, according to one embodiment. Brake actuating device is used synonymously with brake actuator, according to one embodiment.

The caliper 18 is attached to the bow by mounting bracket 20, according to one embodiment. The mounting bracket 20 is attached to the bow riser 4 between the grip 26 and the upper limb 6, according to one embodiment. The mounting bracket 20 is attached to the bow riser 4 between the grip 26 and the lower limb 8, according to one embodiment. The mounting bracket 20 is located in the position of a cable guard 31 instead of the cable guard 31 and the cable retainer 24, according to one embodiment.

The brake actuating device 28 maintains a position of the strings or cables 16 when pressure is applied to a brake lever 30, according to one embodiment. Applying pressure to the brake lever 30 causes one or more of the brake pads within the caliper 18 to push/come together to impact friction onto one of the two cables 17, preventing at least one of the two cables 17 from moving. The archery bow brake includes one or more of the caliper 18, the brake actuating device 28, the brake lever 30, and the cable 32, according to one embodiment. The archery bow brake can be attached to various configurations, types, or models of compound archery bows to provide facilitate maintaining a full or partial draw of a bow string, by applying friction or pressure to one or more of the bow string 14, strings or cables 16, and/or one or more of the two cables 17, according to one embodiment.

When the compound archery bow 2 is in a drawn position, the strings or cables 16 are wound out of one or both of the cams (or pulley) 10, 12, according to one embodiment. Winding of the string(s) out of the cams 10, 12 retracts the distal ends 11, 13 of the upper limb 6 and the lower limb 8 toward one another, according to one embodiment. Retraction of the upper limb 6 and the lower limb 8 allows for the energy built up in the drawing of the bow string 14 to be stored in the flexing of the limbs, according to one embodiment.

When the bow string 14 is released, the cam 12 (and the cam 10, if it exists) rotate back and the bow limbs are propelled outwards/forward/upward due to the stored energy in the bow limbs, thus accelerating the speed at which the bow string 14 travels forward to propel an arrow (not shown), according to one embodiment. When the archery bow brake is engaged, the friction upon the string (e.g., one of the two cables 17 or one of the strings or cables 16) prevents the string from being released which prevents the cams from turning and the bow limbs from propounding away from one another, and thus prevents the energy stored in the bow limbs to be transferred to the retracting bow string 14, according to one embodiment. The depression distance of the brake lever 30 is depicted in FIG. 1 by distance A.

Figure 2:
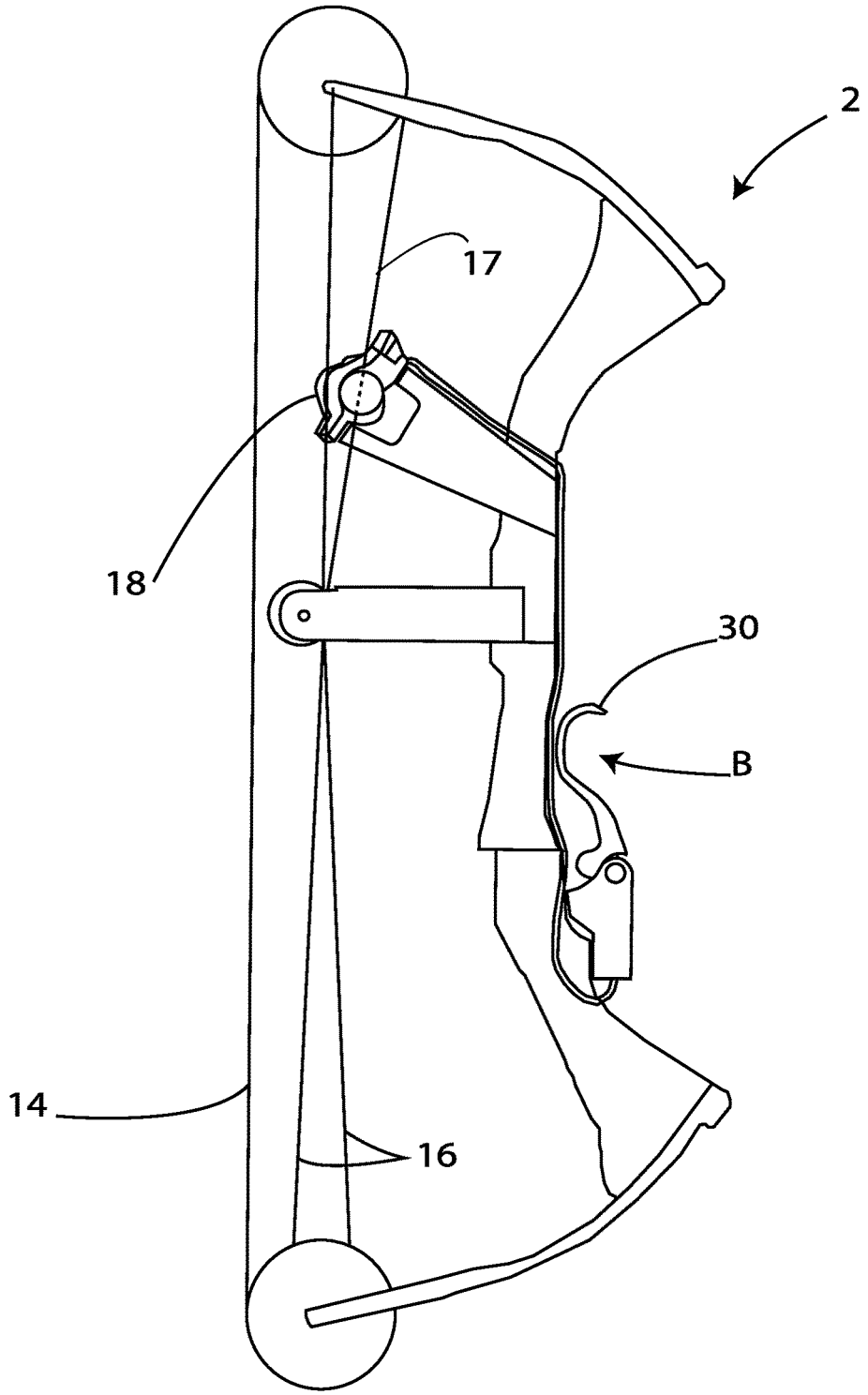
FIG. 2 is a perspective view of a compound archery bow including an embodiment of an archery bow brake in which the actuator is depressed thus actuating the brake on the cable of the bow, according to one embodiment.

FIG. 2 illustrates depression of the brake lever 30 for the compound archery bow 2, in the direction depicted by arrow B. When the brake lever 30 is actuated or depressed as shown in FIG. 2, the brake pads of the caliper 18 are pressed together to impart friction from opposing sides of the string 17 to effectually brake or maintain position of the string, according to one embodiment. In one embodiment, depression of the brake lever 30 causes one of 2 brake pads of the caliper 18 to move in order to impart friction to one of the strings or cables 16 and 17. An archery bow user can actuate the brake mechanism while the bow is at full or partial draw, in order to prevent the strings or cables 16 and 17 and the bow string 14 from moving and preventing the cams from rotating.

Figure 3:
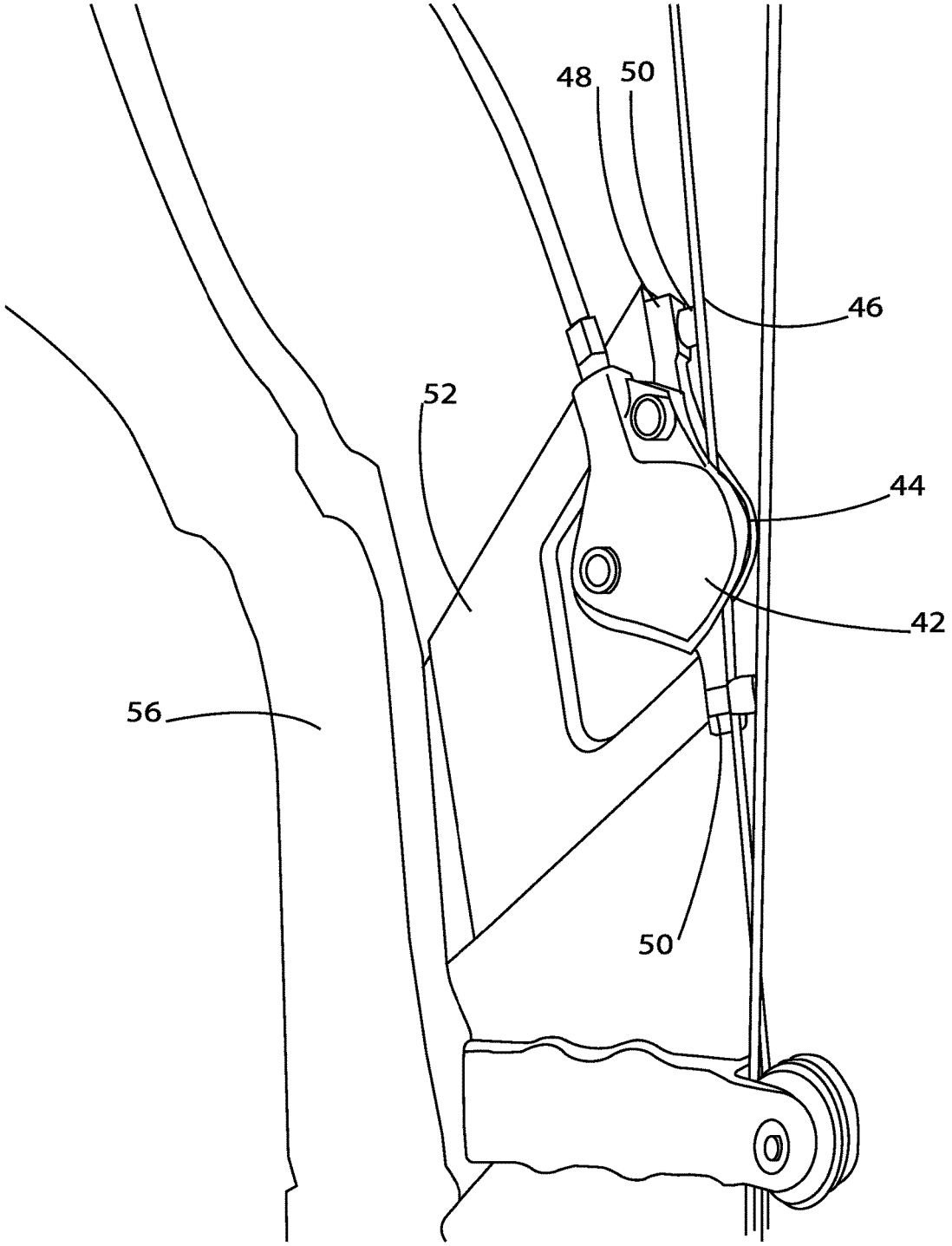
FIG. 3 is an enlarged view of an embodiment of a caliper of an archery bow brake, according to one embodiment.

FIG. 3 illustrates a magnified view of one implementation and embodiment of the archery bow brake of the compound archery bow 2 (shown in FIG. 1), according to one embodiment. Brake caliper 42 is attached to a mounting bracket 52 by a bracket 48 and one or more mounting bolts 50. The mounting bracket 52 is connected to a bow riser 56. The brake caliper 42 is attached to the bow riser 56 such that the bow string 46 (e.g., a bus cable or control cable) passes within a groove 44 (e.g., an opening or cut-out) of the caliper in which the brake pads of the brake caliper 42 are located. Alternatively, it is thought that a variety of mechanisms could be used to brake the string without deviating from the disclosed embodiments. Alternative braking mechanisms could include, for example, a device in which 360 degrees of friction is applied to the string or alternatively, any other friction placing device in which friction is applied to at least one side the bow string 46, according to one embodiment.

Figure 4A:
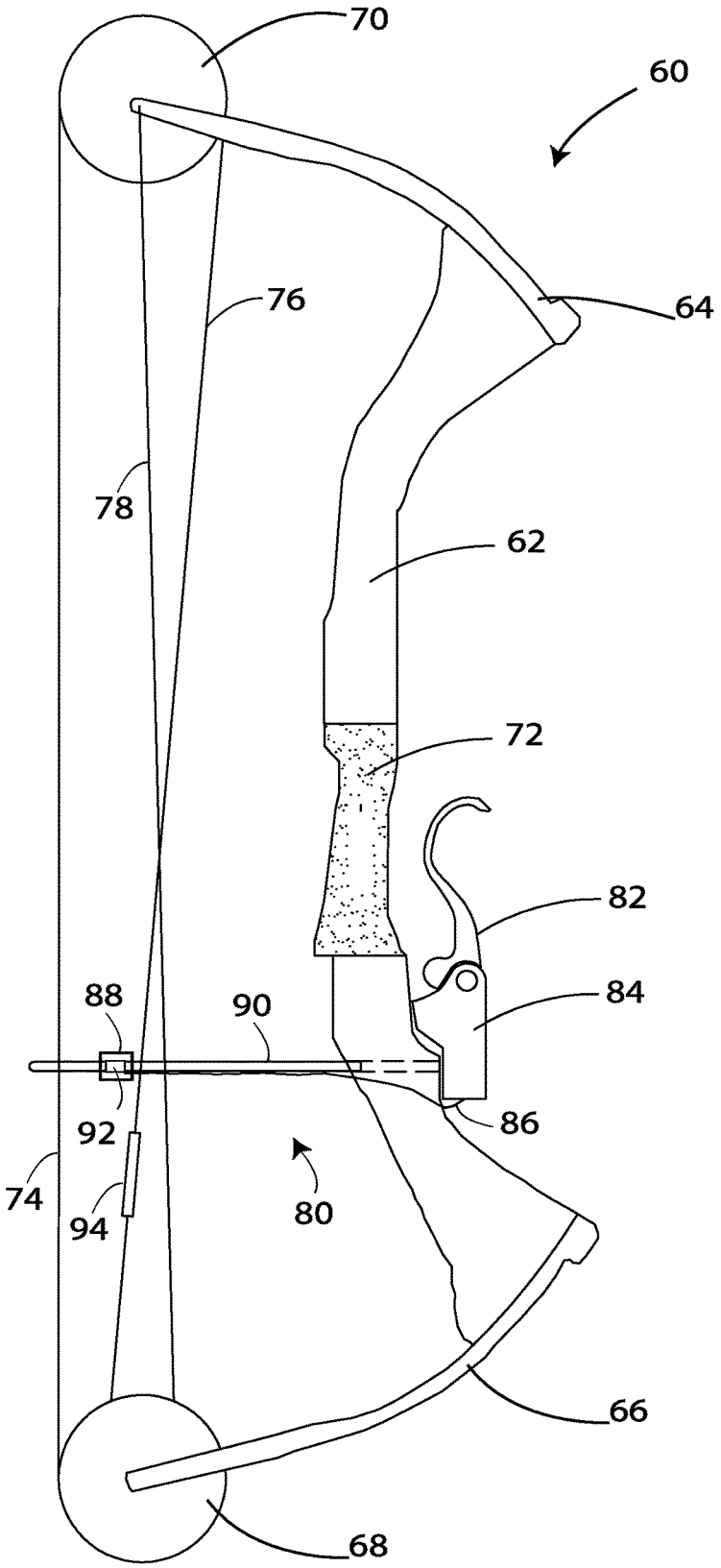
FIGS. 4A, 4B and 4C are perspective views of a compound archery bow including an embodiment of an archery bow brake, according to one embodiment.
Figure 4B:
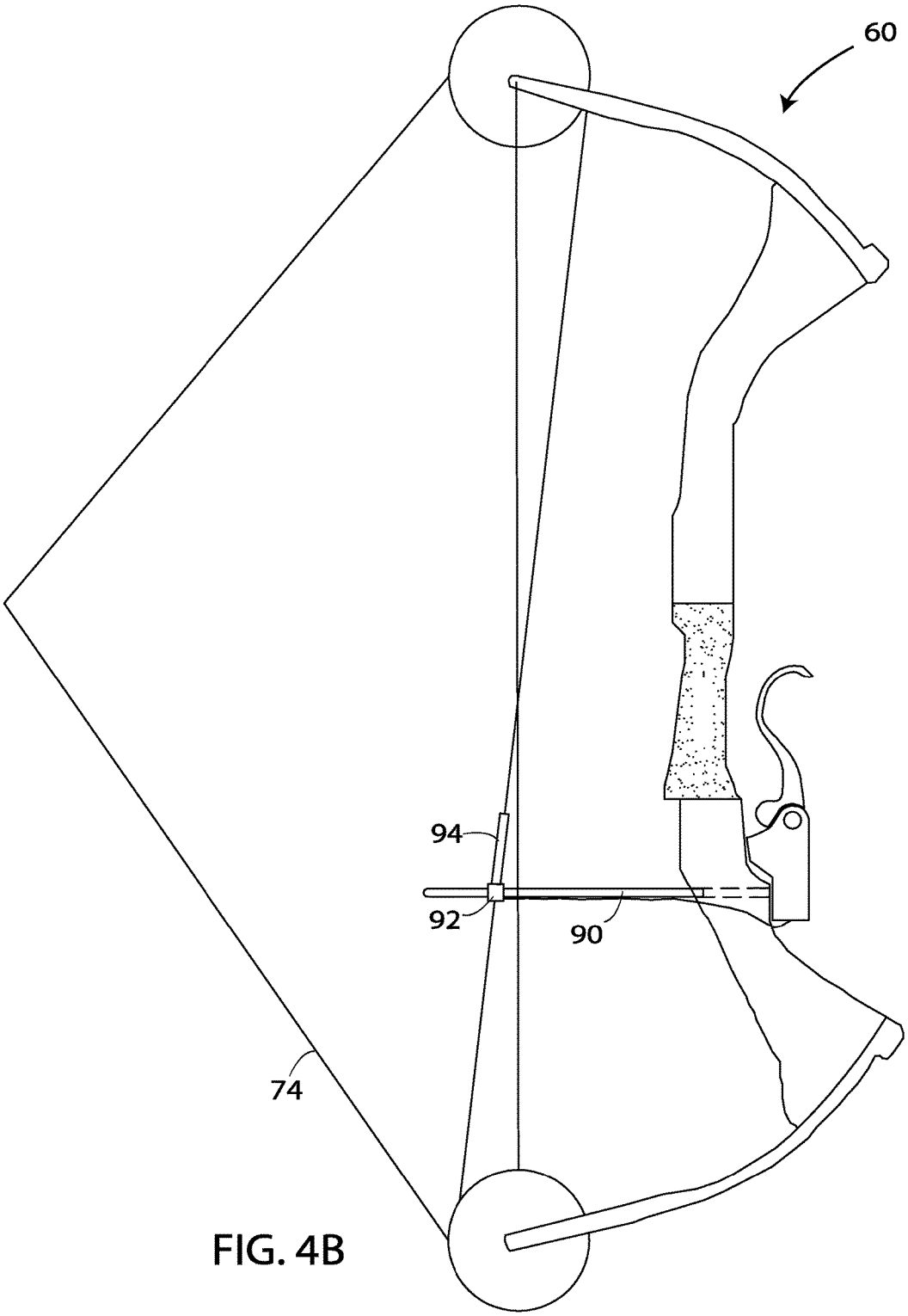
Figure 4C:
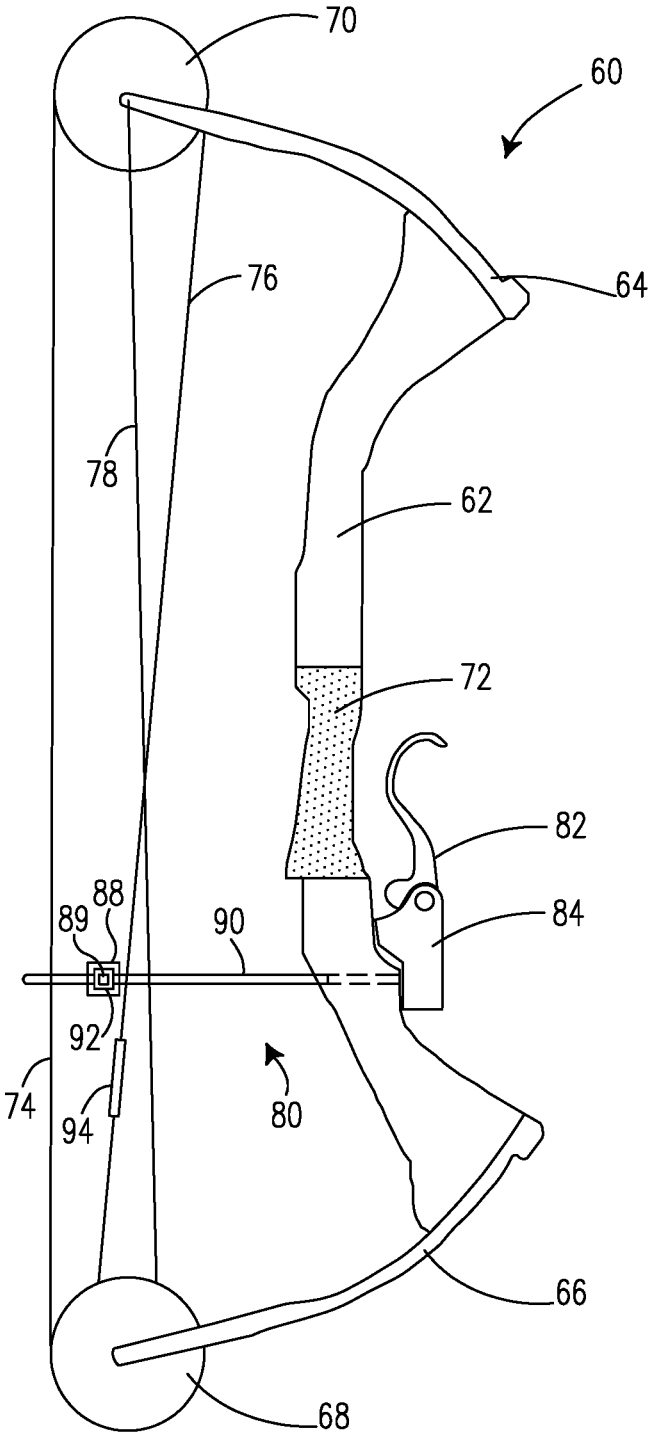

FIGS. 4A and 4B illustrate an embodiment of an archery bow brake that can be applied to various configurations of a compound archery bow, such as a compound archery bow 60, to cause the compound archery bow 60 to maintain a full or partial draw of a bow string, in response to actuating the archery bow brake, according to one embodiment. The compound archery bow 60 includes a bow riser 62, an upper limb 64, a lower limb 66, a first cam 68, a second cam 70, a grip or handle 72, a bow string 74, a control cable 76, a bus cable 78, and an archery bow brake 80, according to one embodiment. In one embodiment, the bow string 74 and the control cable 76 are a single piece of cable that wrap around the second cam 70, according to one embodiment. The bow string 74, the control cable 76, and the bus cable 78 are collectively referred to herein as the bow string, according to one embodiment. In one embodiment, the bow string includes 4 or more cables extending between the upper limb 64 and the lower limb 66, configured to propel an arrow from the bow riser 72.

The archery bow brake 80 is mounted/affixed to the compound archery bow 60, to reduce or remove an archery bow user's effort or exertion needed to maintain the bow string 74 in a full or partial draw, according to one embodiment. The archery bow brake 80 includes a brake lever 82 pivotably attached to a brake actuating device 84, an actuation cable 86 coupled between the brake actuating device 84, and a bow string displacer 88, according to one embodiment. The archery bow brake 80 also includes a cable rod 90 that is attached to the bow riser 62 and that is adapted to retain the control cable 76 and/or the bus cable 78, in order to maintain a full or partial draw of the bow string 74, according to one embodiment. The cable rod 90 can be referred to by different names (e.g., an accessory rod), but the cable rod 90 is used to prevent vertical or linear motion of one or more cables, according to one embodiment. The archery bow brake 80 includes a notch 92 in the cable rod 90 that receives the control cable 76 or the bus cable 78 and retains a position of the control cable 76 or the bus cable 78, in order to maintain a full or partial draw of the bow string 74, according to one embodiment. In one embodiment, the cable rod 90 is attached to the compound archery bow 60 in addition to a cable guard (shown in FIG. 1) that functions to position the control cable 76 and/or the bus cable 78 away from an arrow or arrow fletching that is being shot from the compound archery bow 60.

The archery bow brake 80 functions in response to the depression, pulling, squeezing, pivoting, or otherwise actuation of the brake lever 82, according to one embodiment. When the brake lever 82 is depressed, held, squeezed, pivoted, or otherwise actuated, the brake actuator 82 mechanically, hydraulically, electrically moves the bow string displacer 88, which causes the control cable 76 or bus cable 78 to be displaced and retained into the notch 92 of the cable rod 90, according to one embodiment. In one embodiment, the bow string displacer 88 is a paddle that pivots at one end and swings on another end to pull the control cable 76 or the bus cable 78 into the notch 92, in order to enable the archery bow brake 80 to maintain the position of the fully or partially drawn bow string 74. In one embodiment, the bow string displacer 88 is a hook that at least partially surrounds the control cable 76 or the bus cable 78 and that pulls the control cable 76 or the bus cable 78 into the notch 92. The bow string displacer 88 pulls the control cable 76 or the bus cable 78 into the notch 92, in order to enable the archery bow brake 80 to maintain the position of the fully or partially drawn bow string 74. The bow string displacer 88 pulls or otherwise displaces the control cable 76 or the bus cable 78 into the notch 92, in response to actuation of the brake lever 82, according to one embodiment.

A ferrule 94 is affixed to the control cable 76, to maintain the position of the control cable 76 in the notch 92 when the bow string displacer 88 pulls or displaces the control cable into the notch 92, according to one embodiment. Multiple ferrules (similar to ferrule 94) are attached along the control cable 76 and/or along the bus cable 78 in order to provide multi-positional braking with the archery bow brake 80, according to one embodiment. In one embodiment, a first ferrule is affixed to a first position on the control cable 76, a second ferrule is affixed to a second position on the control cable 76, and a third ferrule is affixed to a third position on the control cable 76, in order to enable the archery bow brake 80 to maintain a first, a second, or a third draw position with the notch 92.

According to various embodiments, instead of or in addition to the ferrule 94, the control cable 76 and/or the bus cable 78 are affixed with other bow string accessories. Various examples of other bow string accessories that can be affixed to the control cable 76 and/or the bus cable 78 to maintain the position of the control cable 76 and/or the bus cable 78 in the notch 92 and/or with respect to the cable rod 90, include, but are not limited to, a tied knot in the control cable 76 and/or the bus cable 78, a loop tied onto the control cable 76 and/or the bus cable 78, a string nock affixed to the control cable 76 and/or the bus cable 78, a kisser button affixed to the control cable 76 and/or the bus cable 78, serving wrapped around or otherwise affixed to the control cable 76 and/or the bus cable 78, and a metal object or magnet, affixed to the control cable 76 and/or the bus cable 78 (in conjunction with a magnet 89 attached to the cable rod 90), according to various embodiments. Additional example implementations of the bow string displacer 88 include, but are not limited to, a hook, a lever or paddle, a metal object or a magnet that utilizes electromagnetic or magnetic attraction/force to retain the position of the control cable 76 and/or the bus cable 78, or a displaceable notch, according to one embodiment. An example of a displaceable notch is a piece of metal that is displaceable and affixed to the cable rod 90 and that is displaced out towards the control cable 76 and/or the bus cable 78 in response to actuation of the brake lever 82, in order to retain/maintain a position of the bow string. The cable rod 90 is a modified version of a string stop, string decelerator, damping rod, or other rigid bar that extends from the bow riser 62 towards the bow string 74, according to one embodiment.

The archery bow brake (e.g., the bow string displacer 88) holds the draw position of the bow at any position in the draw cycle by preventing vertical travel (e.g., linear motion from limb to limb) of one or more cables (e.g., the control cable 76, the bus cable 78, etc.), according to one embodiment. Holding the draw position of the bow by preventing vertical travel (or linear motion) of one or more strings and/or cables prevents the cam or cams from rotating back to the (non-drawn) resting position and prevents the limbs (e.g., an upper limb and a lower limb) from returning to the (non-drawn) resting position, in order to maintain all (or substantially all) of the energy the archer has transferred to the compound archery bow during the draw cycle. If the compound archery bow includes 2 cams and/or 3 or more strings or cables, the archery bow brake applies friction to or otherwise retains at least 2 strings or cables, in order to prevent the vertical travel of the at least 2 strings or cables to prevent the limbs from returning to the (non-drawn) resting position, according to one embodiment. In one embodiment, the archery bow brake applies friction (e.g., with a plunger) to 2 or more strings or cables at the pulleys of a cable guard, to prevent the limbs from returning to the resting position. In one embodiment, the archery bow brake applies friction to 2 or more strings or cables at the cable rod 90 or at a cable guard using a caliper or other friction applying mechanism, to prevent vertical travel (or linear motion) of the 2 or more strings, to prevent the limbs from returning to the resting position, according to one embodiment.

FIG. 4B illustrates the ferrule 94 being held in position by the notch 92 in the cable rod 90 to maintain a full or partial draw of the bow string 74, according to one embodiment.

Figure 5:
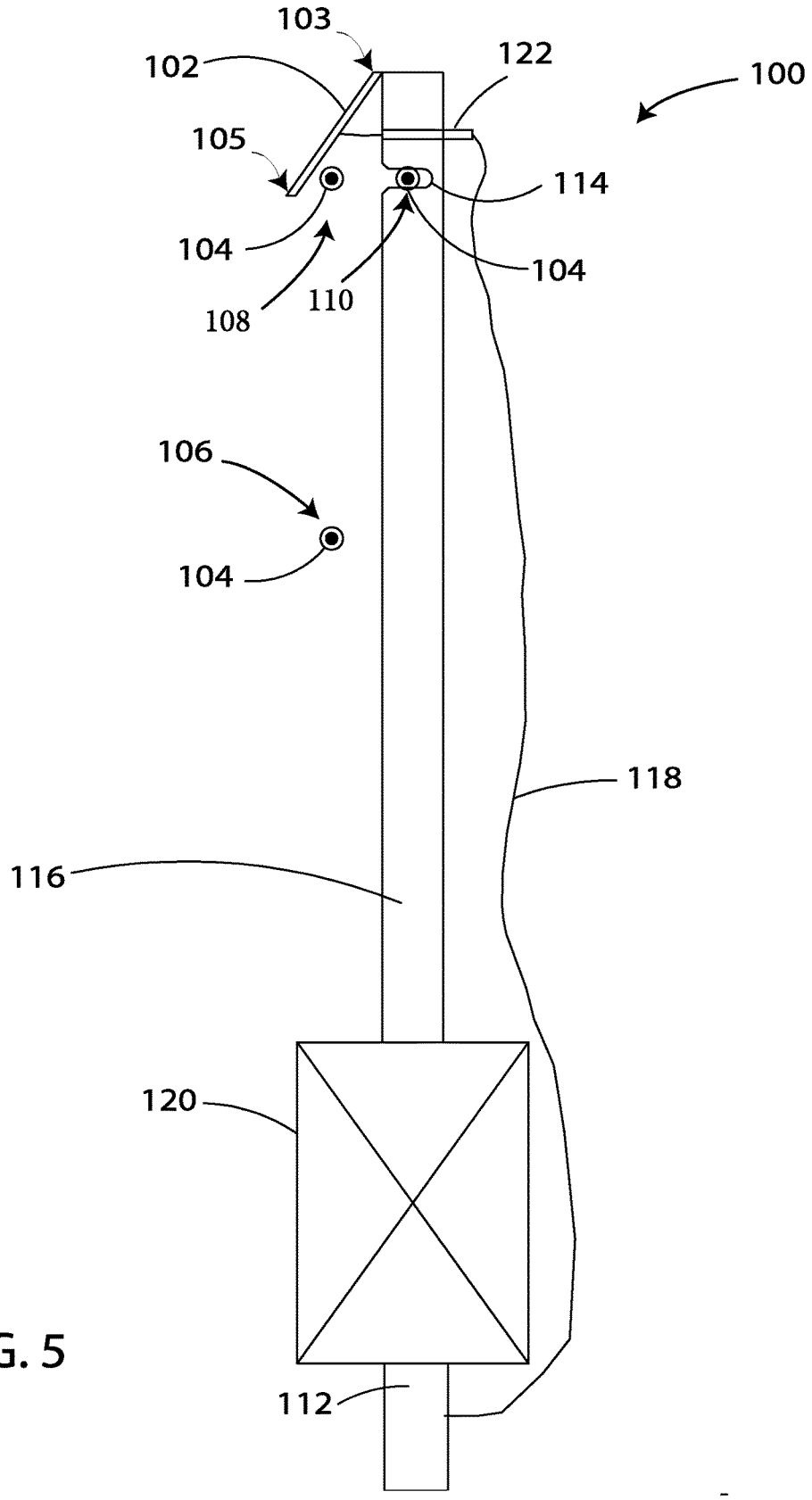
FIG. 5 is a top view of an implementation of an archery bow brake, according to one embodiment.

FIG. 5 illustrates an example implementation of an archery bow brake 100 that includes a flexible paddle 102 for a bow string displacer, according to one embodiment. A bow string 104 (e.g., the control cable) moves from a first position 106 to a second position 108 when the bow string 104 is drawn (e.g., in a full or partial draw), according to one embodiment. In response to actuation of the flexible paddle 102 with the brake actuating device 112 (e.g., and with a brake lever), the bow string 104 is displaced from the second position 108 to a third position 110 into a notch 114 that is formed in the cable rod 116 (e.g., a rigid rod), according to one embodiment. The notch 114 is an after-market accessory or add-on that is added onto an existing cable rod 116, according to one embodiment. The notch 114 is formed into plastic, metal, carbon, or some other material that can be fastened by screw, bolts, brackets, or other mounting hardware, according to one embodiment. The flexible paddle 102 is square, rectangular, ovular, circular, or otherwise polygonal, according to one embodiment. The flexible paddle 102 hinges on a first end 103 and swings on a second end 105, according to one embodiment. The brake actuating device 112 causes the flexible paddle 102 to hinge with cable 118 (e.g., an actuation cable), to displace the bow string 104 into the notch 114, according to one embodiment. The cable rod 116 is inserted into, extends from, and/or is attached to a bow riser 120, according to one embodiment.

The cable 118 extends through the cable rod 116 and/or through a ferrule 122, to facilitate actuation (e.g., sliding towards the cable rod 116) of the paddle 102, according to one embodiment. The ferrule 122 is coupled to the top or bottom of the cable rod 116, according to one embodiment.

Figure 6:
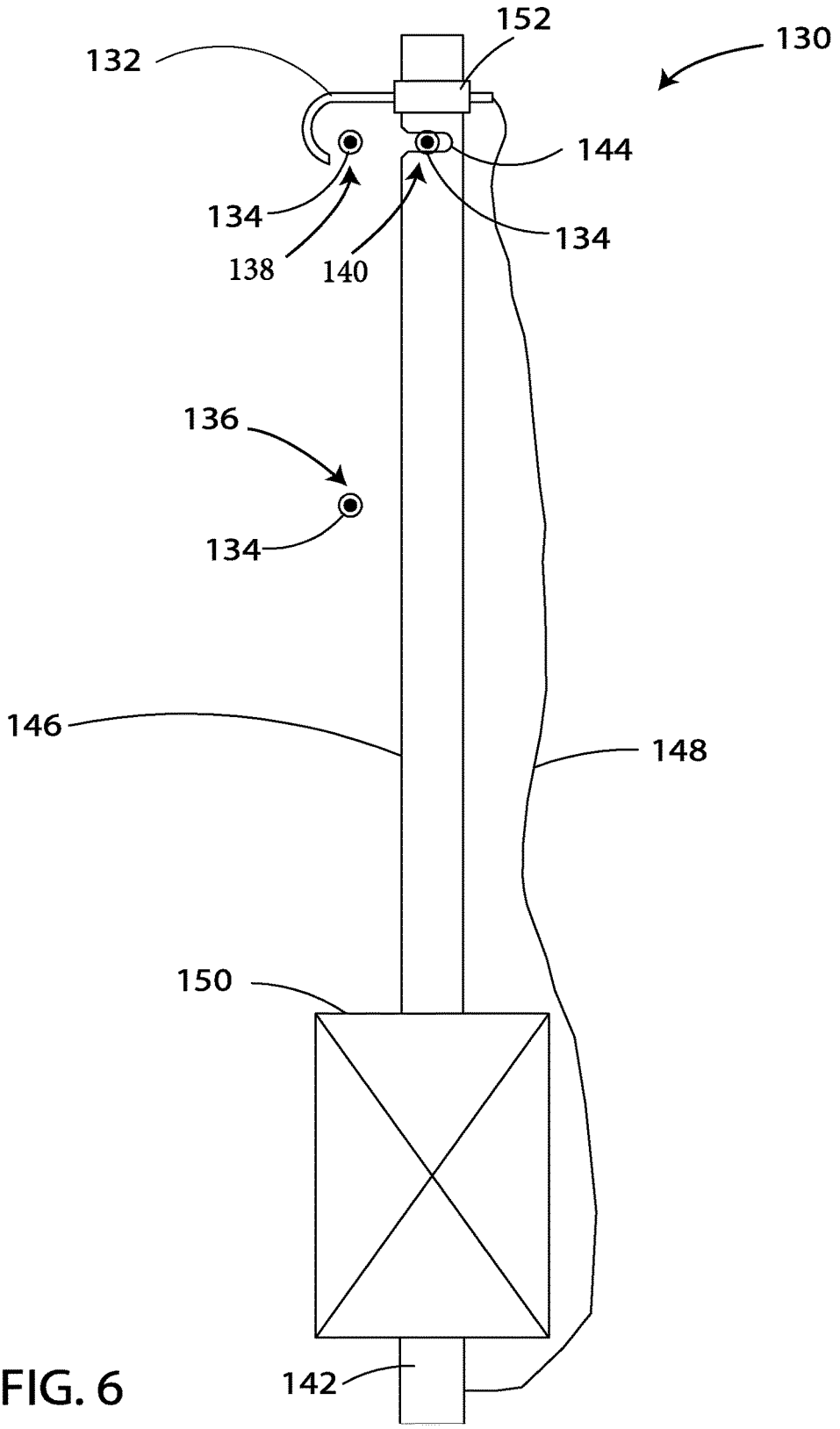
FIG. 6 is a top view of an implementation of an archery bow brake, according to one embodiment.

FIG. 6 illustrates an example implementation of an archery bow brake 130 that includes a hook 132 for a bow string displacer, according to one embodiment. A bow string 134 (e.g., the control cable) moves from a first position 136 to a second position 138 when the bow string 134 is drawn (e.g., in a full or partial draw), according to one embodiment. In response to actuation of the hook 132 with the brake actuating device 142 (e.g., and with a brake lever), the bow string 134 is displaced from the second position 138 to a third position 140 into a notch 144 that is formed in the cable rod 146 (e.g., a rigid rod), according to one embodiment. The notch 144 is an after-market accessory or add-on that is added onto an existing cable rod 146, according to one embodiment. The notch 144 is formed into plastic, metal, carbon, or some other material that can be fastened by screw, bolts, brackets, or other mounting hardware, according to one embodiment. The brake actuating device 142 causes the hook 132 to slide perpendicularly from the cable rod 146, with cable 148 (e.g., an actuation cable), to displace the bow string 134 into the notch 144, according to one embodiment. The cable rod 146 is inserted into, extends from, and/or is attached to a bow riser 150, according to one embodiment.

The cable 148 extends through the cable rod 146 and/or through a ferrule 152, to facilitate actuation (e.g., sliding towards the cable rod 146) of the hook 132, according to one embodiment. The ferrule 152 is coupled to the top or bottom of the cable rod 146, according to one embodiment.

While certain embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

In the discussion above, certain aspects of one embodiment include process steps or operations or instructions described herein for illustrative purposes in a particular order or grouping. However, the particular order or grouping shown and discussed herein are illustrative only and not limiting. Those of skill in the art will recognize that other orders or grouping of the process steps or operations or components are possible and, in some embodiments, one or more of the process steps or operations or instructions discussed above can be combined or deleted. In addition, portions of one or more of the process steps or operations or components can be re-grouped as portions of one or more other of the process steps or operations or instructions discussed herein. Consequently, the particular order or grouping of the process steps or operations or components discussed herein do not limit the scope of the invention as claimed below.

As discussed in more detail above, using the above embodiments, with little or no modification or input, there is considerable flexibility, adaptability, and opportunity for customization to meet the specific needs of various users under numerous circumstances.

The present invention has been described in particular detail with respect to specific possible embodiments. Those of skill in the art will appreciate that the invention may be practiced in other embodiments. For example, the nomenclature used for components, capitalization of component designations and terms, the attributes, or any other structural aspect is not significant, mandatory, or limiting, and the mechanisms that implement the invention or its features can have various different names, formats, or protocols. Also, particular divisions of functionality between the various components described herein are merely exemplary, and not mandatory or significant. Consequently, functions performed by a single component may, in other embodiments, be performed by multiple components, and functions performed by multiple components may, in other embodiments, be performed by a single component.

It should also be noted that the language used in the specification has been principally selected for readability, clarity and instructional purposes, and may not have been selected to delineate or circumscribe the inventive subject matter. Accordingly, the disclosure of the present invention is intended to be illustrative, but not limiting, of the scope of the invention, which is set forth in the claims below.

In addition, the operations shown in the figures, or as discussed herein, are identified using a particular nomenclature for ease of description and understanding, but other nomenclature is often used in the art to identify equivalent operations.

Therefore, numerous variations, whether explicitly provided for by the specification or implied by the specification or not, may be implemented by one of skill in the art in view of this disclosure.

What is claimed is:

1. A compound archery bow, wherein said compound archery bow comprises:

a bow riser;

a first limb and a second limb, wherein each of the first limb and the second limb are attached to the bow riser;

a bow string strung between the first limb and the second limb;

a control cable strung between the first limb and the second limb, wherein the control cable moves towards the first limb or the second limb if the bow string is at least partially drawn;

a bus cable strung between the first limb and the second limb;

a cable rod attached to the bow riser; wherein the cable rod extends towards the bow string, wherein the cable rod includes a notch; and an archery bow brake including a brake lever and a bow string displacer, wherein the bow string displacer displaces the control cable or the bus cable into the notch, in response to actuation of the brake lever, to maintain a linear position of the control cable or the bus cable between the first limb and the second limb.

2. The compound archery bow of claim 1, wherein the archery bow brake includes a brake actuation device coupled between the brake lever and the bow string displacer.

3. The compound archery bow of claim 2, wherein the brake actuation device actuates the bow string displacer in response to actuation of the brake lever.

4. The compound archery bow of claim 2, wherein the brake actuation device actuates the bow string displacer hydraulically, mechanically, electrically, or wirelessly using an electromagnetic signal.

5. The compound archery bow of claim 1, wherein the control cable or the bus cable are affixed with one or more accessories that cause the control cable or the bus cable to maintain a linear position in the notch between the first limb and the second limb.

6. The compound archery bow of claim 5, wherein the one or more accessories include one or more of a tied knot in the control cable or the bus cable, a loop tied onto the control cable or the bus cable, a ferrule attached to the control cable or the bus cable, a string nock, a kisser button, and serving wrapped around the control cable or the bus cable.

7. The compound archery bow of claim 5, wherein the one or more accessories include a metal object or a magnet that is magnetically attracted to a magnet located on the cable rod, to maintain a linear position of the control cable or the bus cable between the first limb and the second limb.

8. The compound archery bow of claim 1, wherein the bow string displacer includes at least one of a hook, a paddle, a magnet that applies magnetic force to a metal object affixed to the control cable or bus cable, and a metal object that is magnetically attracted to a magnet affixed to the control cable or bus cable.

9. The compound archery bow of claim 1, wherein the notch is formed into the cable rod.

10. The compound archery bow of claim 1, wherein the notch is an accessory that is mounted onto the cable rod.

11. The compound archery bow of claim 1, further comprising at least one of a first cam rotatably mounted to the first limb, a second cam rotatably mounted to the second limb, and both a first cam rotatably mounted to the first limb and a second cam rotatably mounted to the second limb, wherein the first limb is an upper limb and the second limb is a lower limb.

12. A method of reducing a holding force on a compound archery bow, while the compound archery bow is fully or partially drawn, the method comprising:

providing a compound archery bow;

providing an archery bow brake that includes a bow string displacer that is responsive to a brake actuation mechanism;

receiving brake actuation from the brake actuation mechanism;

displacing at least part of a bow string into a notch of a cable rod, in response to receiving the brake actuation, to maintain a linear position of the at least part of the bow string, to reduce a holding force of the bow string while the compound archery bow is fully or partially drawn.

13. The method of claim 12, wherein the brake actuation mechanism includes at least one of a brake lever, a brake trigger, and a brake button that actuate the bow string displacer.

14. The method of claim 12, wherein the cable rod is attached to a bow riser of the compound archery bow, wherein the cable rod is approximately perpendicular to the bow riser, wherein the cable rod is at least partially disposed between the cable rod and the bow string.

15. The method of claim 12, wherein the bow string displacer includes at least one of a hook, a paddle, a magnet that applies magnetic force to a metal object affixed to the bow string, and a metal object that is magnetically attracted to a magnet affixed to the bow string.

* * * * *